United States Patent [19]

Wundt et al.

[11] Patent Number: 4,830,668

[45] Date of Patent: May 16, 1989

[54] ACIDIC BATH FOR ELECTROLESS DEPOSITION OF GOLD FILMS

[75] Inventors: Konrad Wundt, Marburg; Burkhard Mankau, Gründau; Jutta Schaad, Offenbach, all of Fed. Rep. of Germany

[73] Assignee: W. C. Heraeus GmbH, Hanau, Fed. Rep. of Germany

[21] Appl. No.: 130,082

[22] Filed: Dec. 8, 1987

[51] Int. Cl.[4] ..... C23C 18/44

[52] U.S. Cl. ..... 106/123; 106/126; 427/304; 427/437; 427/443.1; 204/38.4

[58] Field of Search ..... 106/1.23, 1.26; 427/304, 437, 443.1; 204/38.4

[56] References Cited

U.S. PATENT DOCUMENTS

| | | | |
|---|---|---|---|
| 3,032,436 | 5/1962 | Gostin et al. | 106/1.26 |
| 3,671,291 | 6/1972 | Miller et al. | 106/1.26 |
| 3,697,296 | 10/1972 | Bells | 106/1.26 |
| 3,878,068 | 4/1975 | Bick et al. | 204/443 |
| 4,169,171 | 10/1976 | Narcus | 427/304 |
| 4,337,091 | 6/1982 | El-Shazly et al. | 106/1.23 |
| 4,352,690 | 10/1982 | Dettke et al. | 106/1.23 |
| 4,374,876 | 2/1983 | El-Shazly et al. | 106/1.23 |

FOREIGN PATENT DOCUMENTS

| | | |
|---|---|---|
| 3210268 | 4/1984 | Fed. Rep. of Germany . |
| 3247144 | 1/1985 | Fed. Rep. of Germany . |
| 3320308 | 5/1985 | Fed. Rep. of Germany . |
| 3614090 | 4/1987 | Fed. Rep. of Germany . |
| 2034756 | 6/1981 | United Kingdom . |
| 2114159 | 8/1983 | United Kingdom . |
| 2121444 | 12/1983 | United Kingdom . |

*Primary Examiner*—Prince E. Willis
*Assistant Examiner*—Helene Kirschner
*Attorney, Agent, or Firm*—Frishauf, Holtz, Goodman & Woodward

[57] ABSTRACT

In an aqueous bath for electroless deposition of gold films, of the type containing a source of gold in oxidized form, a reducing agent, a stabilizer of 2-mercaptobenzothiazole or a derivative thereof, the improvement comprising said source of gold being a gold complex which is the reaction product of an alkali metal cyanoaurate (III) and a complexing agent selected from the group consisting of ethylenediaminetetramethylene-phosphonic acid and 1-hydroxythane-1,1-diphosphonic acid in aqueous solution; said aqueous bath having a pH value between 0.2 and 1.8.

18 Claims, No Drawings

ACIDIC BATH FOR ELECTROLESS DEPOSITION OF GOLD FILMS

BACKGROUND OF THE INVENTION

The present invention relates to an aqueous bath for electroless or currentless deposition of gold films, which in addition to a reducing agent and a stabilizer of 2-mercaptobenzothiazole or a derivative thereof contains a gold complex obtained from an anionic gold(III) compound and a complexing agent in aqueous solution.

BACKGROUND

Although many electroless or currentless gold baths are known, a bath that is suitable for depositing gold films having special properties is often difficult or even impossible to find.

Among the special properties that gold films should have that are to be used for electronic applications, for example, are the lowest possible porosity, film thicknesses of approximately 0.5 to 10 micrometers, strong adhesion to the substrate and good solderability and bondability.

U.S. Pat. No. 3,032,436 describes a method for the deposition of gold from a bath that contains potassium gold cyanide and has a pH value between 3 and 12. The preferred reducing agent is hydrazine hydrate; the use of other reducing agents, such as alkali metal hydridoborates, sugars, hydroquinones and alkali metal hypophosphites, is also possible, however.

From German Pat. No. 32 10 268, an aqueous alkaline bath for the electroless deposition of gold coatings is known, which is characterized by the use of gold in the form of a gold(III) compound, for example alkali metal cyanoaurate(III). The bath is more stable and has a higher deposition rate than baths that contain gold(I) compounds. Besides the gold(III) compound, a buffer substance and optionally an organic complexing agent (chelating agent), such as ethylenediaminetetraacetic acid, and/or free cyanide, it contains an alkylaminoborane, alkali metal boranate or alkali metal cyanoboranate as a reducing agent.

German Pat. No. 32 47 144 describes an aqueous alkaline bath for electroless gold plating that contains gold in the form of gold(III) complex with borate, carbonate, phosphate, pyrophosphate or silicate ligands. Suitable stabilizers that can be added to the bath also include mercaptans, such as 2-mercaptobenzothiazole. As a reducing agent, a soluble tertiary aminerborane or the diisopropylaminoborane is used. The bath is prepared by heating an aqueous solution containing the gold(III) compound, such as potassium tetrachloraurate(III), and the inorganic ligand, and by adding the reducing agent and the stabilizer to the solution after the solution has cooled.

An alkaline bath for electroless deposition of gold that contains gold in the form of both a gold(I) and a gold(III) component, such as alkali metal cyanoaurate(III), and that is stable, enables better deposition rates and can be regenerated is known from German Pat. No. 33 20 308. As a reducing agent, alkylaminoboranes, alkalimetal boron hydrides, alkali metal cyanoboron hydrides, hydrazine or hyposulfite is used here. If greater stability is required, alkali metal cyanides in an amount from 1 to 20 g/l can be added to the bath.

From German Patent Application No. P 36 14 090.2, an aqueous alkaline bath for the electroless deposition of gold films is known, which contains gold in the form of alkali metal cyanoaurate(III), an organic complexing agent such as ethylenediaminetetramethylenephosphonic acid or 1-hydroxyethane-1,1-di-phosphonic acid, 2-mercaptobenzothiazole or a derivative thereof as a stabilizer, and a mixture of at least two reducing agents one of which may be a hypophosphite, and has a pH value between 8 and 14.

THE INVENTION

It is the object of the invention to provide a bath of the above-defined type which—without containing free cyanide—has great stability, and from which gold films suitable for electrical and electronic applications can be deposited at the most constant possible deposition rate. The stability of the bath should be such—in the event of regeneration in accordance with the use of gold and the other components of the bath—that three times the amount of gold contained in the starting electrolyte can be deposited.

Briefly, the bath by which this object is attained is defined in that it contains the gold complex obtained by letting the aqueous solution of an alkali metal cyanoaurate(III) and ethylenediaminetetramethylenephosphonic acid or 1-hydroxyethane-1,1-diphosphonic acid, as a complexing agent, stand for at least 24 hours at room temperature.

At least 24 hours are required to ensure complete formation of the complex usable in the bath.

Prior to being let stand at room temperature, the aqueous solution is advantageously heated to approximately 80° C. to aid in dissolving reagents.

The bath has a working temperature between 85° and 100° C. and a working pH value between 0.2 and 1.8.

It has

It has proved to be particularly suitable for the aqueous solution to contain from 0.5 to 15 g/l, and preferably 1 to 10 g/l, of gold as the alkali metal cyanoaurate(III) and from 2.5 to 45 g/l, preferably 7.5 to 20 g/l, of the complexing agent.

From the bath according to the invention, fine-crystalline gold films can be deposited onto metals, such as nickel and copper, and onto non-metals, such as ceramic and plastic, that have been provided with a catalytically activated surface by means of suitable pre-treatment by methods known in the art. The deposition rate, in the range from 1 to 2 μm/h, is practically constant.

Unexpectedly, the gold films have a high adhesive strength, a regular layer structure and excellent solderability and bondability. They are particularly well suited for electronic applications, such as for gold plating of leadframes, chip substrates, circuit boards, the conductor tracks of hybrid circuits and the inner walls of hollow articles such as hollow tubes.

It is simple to regenerate the bath during operation by the continuous addition of aqueous solutions that contain the substances making up the bath, but in a lesser concentration than in the bath. The substances used for regenerating the bath are added in amounts corresponding to the amount of gold deposited. With suitable regeneration, three times the amount of gold contained in a newly started bath can be deposited.

The term alkali metal cyanoaurate(III) is understood to mean the cyanoaurate(III) of a suitable alkali metal, or the ammonium cyanoaurate(III); the reaction product of ethylenediaminetetramethylenephosphonic acid or of 1-hydroxyethane-1,1-diphosphonic acid with potassium cyanoaurate(III) has proved to be particularly effective.

As the reducing agent, hypophosphites, and particularly the alkali metal hypophosphites, have proved to be suitable; the sodium compound is preferred.

The amount of the reducing agent is dependent on the gold content of the bath and is selected such that a continuous buildup of the gold film with a defined film thickness takes place.

Besides the 2-mercaptobenzothiazole itself, the 2-mercaptobenzothiazole-S-propane sulfonic acid, in the form of its alkali metal salts, preferably the sodium salt, has provided to be a particularly effective stabilizer. The effective amount of the stabilizer is from 0.01 to 150 mg/l.

To adjust the pH value of the aqueous solution to approximately 0.5 to 0.8 and the working pH value of the bath, hydrochloric acid or citric acid is preferably used.

For some applications, it has proved advantageous for the bath to contain a wetting agent, preferably in an amount from 0.1 to 5 g/l. A suitable wetting agent is for example sodium dodecylether phosphate, which is available in commerce under the name of Forlanon (registered trademark of the Henkel company, Düsseldorf).

Baths according to the invention, their preparation and the deposition of gold films from them are described in further detail in the ensuing examples.

EXAMPLE 1

15 g/l of ethylenediaminetetramethylenephosphonic acid are dissolved in 800 ml of distilled water at a temperature of 80° C.; then 2 g/l of gold are added in the form of potassium cyanoaurate(III). The pH value is adjusted to 0.55 with 50 ml/l of (32%) hydrochloric acid, with the aid of a pH electrode. After cooling to room temperature, the solution is refilled to 1 l and left to stand for 24 hours.

After heating to the working temperature of 92°–97° C., 5 ml/l of stabilizer from a 1-liter solution having 200 mg/l of 2-mercaptobenzothiazole-S-propane sulfonic sodium with the aid of a pipette and 5 ml/l of Forlanon (registered trademark of the Henkel company, Düsseldorf, for the wetting agent sodium dodecylether phosphate) are added, and after that 0.5 ml/l of reducing agent from a 1-liter solution with 100 g/l of sodium hypophosphite is added with the aid of a pipette.

The finished bath having a pH value of approximately 0.5 contains

- 15 g/l of ethylenediaminetetramethylenephosphonic acid,
- 2 g/l of gold as potassium cyanoaurate(III),
- 50 ml/l of HCl, 32% strength,
- 1 mg/l of 2-mercaptobenzothiazole-S-propane sulfonic sodium
- 3 g/l of Forlanon, and
- 50 mg/l of sodium hypophosphite.

From the bath, gold films having a thickness of from 0.6 to 0.8 μm that are uniform, adhere well, are deposited onto electrolessly deposited nickel coatings in 15 minutes. On electrolessly deposited gold coatings, gold films 0.5 μm thick are obtained in 15 minutes and gold films 0.9 to 1.4 μm thick are obtained in 60 minutes.

In the time period observed, the deposition is highly uniform and takes place only on the surfaces intended for the gold plating. Stray deposition, for example on the walls of the storage tank containing the bath, does not occur.

EXAMPLE 2

30 gl/l of 1-hydroxyethane-1,1-diphosphonic acid are diluted with 800 ml of distilled water; then 4 g/l of gold are added in the form of potassium cyanoaurate(III). The pH value is adjusted electrometrically to 0.6 with (32%) hydrochloric acid and the solution is refilled to make 1 liter and left to stand for 24 hours. Then 2 ml/l of stabilizer from a 1-liter solution having 100 mg/l of 2-mercaptobenzothiazole of and 0.5 ml/l of reducing agent from a 1-liter solution having 100 g/l of sodium hypophosphite are added, each with the aid of a pipette.

The finished bath having a pH value of approximately 0.6 contains

- 30 g/l of 1-hydroxyethane-1,1-diphosphonic acid,
- 4 g/l of gold in the form of potassium cyanoaurate-(III),
- 10 ml/l of HC1, 32% strength,
- 0.2 mg/g of 2-mercaptobenzothiazole, and
- 50 mg/l of sodium hypophosphite.

For the deposition of gold films, the bath is now brought to a working temperature of 92°–97 ° C.

In 15 minutes, gold films from 0.5 to 0.6 μm thick are deposited on electrolessly deposited nickel coatings.

On electrolessly deposited gold coatings, gold films 0.4 μm thick are obtained in 15 minutes and gold films 1.4 to 1.5 μm thick are deposited in 60 minutes.

The deposition is highly uniform within the time period observed and takes place only on the surfaces intended for the gold plating. Stray deposition, for instance onto the walls of the storage tank containing the bath, does not occur.

What is claimed is:

1. In an aqueous bath, for electroless deposition of gold films, of the type containing a source of gold in oxidized form, a reducing agent, and a stabilizer of 2-mercaptobenzothiazole or a derivative thereof, the improvement comprising said source of gold being an aqueous solution of a gold complex which is formed by reacting an alkali metal cyanoaurate (III) or ammonium cyanoaurate (III) and a complexing agent selected from the group consisting of ethylenediaminetetramethylenephosphonic acid and 1-hydroxyethane-1, 1-diphosphonic acid, for at least 24 hours at room temperature; said aqueous bath having a pH value between 0.2 and 1.8.

2. The bath of claim 1 wherein the aqueous solution is heated to about 80° C. and then allowed to cool to said room temperature.

3. The bath of claim 1 having a working temperature between 85° and 100° C.

4. The bath of claim 1, wherein said complex is formed from said aqueous solution containing from 0.5 to 15 g/l of gold in the form of an alkali metal cyanoaurate(III) or of ammonium cyanoaurate(III) and from 2.5 to 45 g/l of the complexing agent.

5. The bath of claim 4, wherein from 1 to 10 g/l of gold in the form of alkali metal cyanoaurate(III) or of ammonium cyanoaurate(III) and from 7.5 to 20 g/l of the complexing agent are used to form said complex.

6. The bath of claim 1 further comprising 0.1 to 5 g/l of a wetting agent.

7. The bath according to claim 1, wherein the aqueous solution is acidic.

8. The bath of claim 7, wherein the aqueous solution contains hydrochloric acid or citric acid.

9. The bath of claim 1, wherein said reducing agent is a hypophosphite.

10. The bath of claim 1, wherein the aqueous solution contains potassium cyanoaurate(III) or ammonium cyanoaurate(III) and ethylenediaminetetra-methylene-phosphonic acid, and the reducing agent is sodium hypophosphite and the stabilizer is the sodium salt of 2-mercaptobenzothiazole-S-propane sulfonic acid.

11. The bath of claim 10, wherein the potassium cyanoaurate(III) is used.

12. The bath of claim 1, wherein the aqueous solution contains potassium cyanoaurate(III) or ammonium cyanoaurate(III) and 1-hydroxyethane-1,1-diphosphonic acid and the reducing agent is sodium hypophosphite and the stabilizer is 2-mercaptobenzothiazole.

13. The bath of claim 12, wherein the potassium cyanoaurate(III) is used.

14. The bath of claim 1, wherein the ammonium cyanoaurate(III) is used.

15. The bath of claim 1, wherein the aqueous solution contains sodium or potassium cyanoaurate(III).

16. The bath of claim 15, wherein the bath contains potassium cyanoaurate(III).

17. The bath of claim 1, wherein the alkali metal cyanoaurate(III) is used.

18. In an aqueous bath for electroless deposition of gold films, of the type containing a source of gold in oxidized form, a reducing agent and a stabilizer of 2-mercaptobenzothiazole or a derivative thereof, the improvement comprising said source of gold being an aqueous solution of a gold complex which is the reaction product of an alkali metal cyanoaurate (III) or ammonium cyanoaurate (III) and a complexing agent selected from the group consisting of ethylenediaminetetra-methylenephosphonic acid and 1-hydroxyethane-1,1-diphosphonic acid; said aqueous bath having a pH value between 0.2 and 1.8.

* * * * *